United States Patent [19]

Ise et al.

[11] Patent Number: 4,861,232

[45] Date of Patent: Aug. 29, 1989

[54] VACUUM GENERATING DEVICE

[75] Inventors: Yoji Ise; Akira Yamaguchi, both of Tokyo, Japan

[73] Assignee: Myotoku Ltd., Tokyo, Japan

[21] Appl. No.: 199,069

[22] Filed: May 26, 1988

[30] Foreign Application Priority Data

May 30, 1987 [JP] Japan ..... 62-84873

[51] Int. Cl.[4] ..... F04F 5/44

[52] U.S. Cl. ..... 417/76; 417/176; 137/884; 248/205.9

[58] Field of Search ..... 417/151, 176, 179, 199; 137/884, 892; 248/205.8, 205.9, 362, 363

[56] References Cited

U.S. PATENT DOCUMENTS

| | | | |
|---|---|---|---|
| D. 295,180 | 4/1988 | Kanno | D15/7 |
| 2,343,269 | 3/1944 | Aaron | 417/176 |
| 3,061,179 | 10/1962 | Pendelton | 417/176 |
| 3,174,136 | 3/1965 | Wanner | 417/273 |
| 3,369,735 | 2/1968 | Hoffmeister | 417/176 |
| 3,481,431 | 12/1969 | Dorsey | 184/7.4 |
| 4,380,418 | 4/1983 | Crawford et al. | 417/87 |
| 4,549,854 | 10/1985 | Yamamoto | 417/187 |

FOREIGN PATENT DOCUMENTS 0482208 3/1917 France .

*Primary Examiner*—Carlton R. Croyle
*Assistant Examiner*—Robert N. Blackmon
*Attorney, Agent, or Firm*—Biebel, French & Nauman

[57] ABSTRACT

A vacuum generating device for an ejector pump is provided. The vacuum generating device according to the present invention comprises an ejector pump mechanism having on one of the side surfaces thereof with an air intake port, air inlet port and exhaust port and attached with a fitting base including an air intake pipe, inlet pipe and exhaust pipe capable of connecting to the ports of the ejector pump mechanism, respectively. The device according to the present invention can be effectively used as one of the units of a vacuum generator assembly in a compact form in which the fitting bases of the units are arranged adjacent to one another with the inlet and exhaust pipes thereof held communicating with each other, respectively, whereby the number of pipes is minimized and the noise level from the assembly is reduced. The device or the assembly is applicable to a sucking device for attracting and sucking an article so as to transfer it to a required place.

1 Claim, 5 Drawing Sheets

VACUUM GENERATING DEVICE

FIELD OF THE INVENTION

The present invention relates to a vacuum generating device and more particularly to such type of device that can be used as one of units of a vacuum generator assembly in a compact form.

BACKGROUND OF THE INVENTION

The conventional vacuum generating ejector pump has required the provision of various pipes such as a compressed air inlet pipe, air intake pipe and etc. to be attached thereto and therefore, it has had disadvantages that when a plurality of pumps are used, piping therefor becomes complicated and further, since the exhaust gases are discharged from the body of the device, not only environmental pollution take place but also noises generate from the device.

SUMMARY OF THE INVENTION

The present invention has been made to eliminate the above-described drawbacks of the conventional vacuum generating device. That is, according to the present invention, there is provided a vacuum generating device comprising an ejector pump mechanism. The ejector pump mechanism is provided in one side surface thereof with an air intake port, air inlet port and exhaust port and a fitting base is attached to that side surface. Accordingly, in case a plurality of such devices are used in the form of an assembly, with the fitting bases of their ejector pump mechanisms attached adjacent to one another to a common fitting rail and their inlet pipes and exhaust pipes held communicating with one another, respectively, the number of pipes can be minimized and if the exhaust pipes are led outside the room, the noise level on the assembly can be controlled to a minimum.

Accordingly, an object of the present invention is to provide a vacuum generating device for an ejector pump which is capable of generating a vacuum in a required system in an effective manner without the provision of complicated pipes.

Another object of the present invention is to provide a vacuum generator assembly in a compact form with the provision of the minimum number of pipes by using a fitting base for each of the vacuum generator units of the assembly so that when the units are assembled, the fitting bases thereof held close to one another.

Still another object of the present invention is to provide a vacuum generating device or a vacuum generator assembly which is capable of reducing the number of pipes attached thereto and controlling the noise level therefrom to a minimum.

A further object of the present invention is to provide a vacuum generating device or a vacuum generator assembly which is applicable to a vacuum sucking device for transferring an article to a desired place.

BRIEF DESCRIPTION OF THE DRAWINGS

The present invention will now be described with reference to the accompanying drawings wherein.

DETAILED DESCRIPTION OF THE INVENTION

Figure 1:
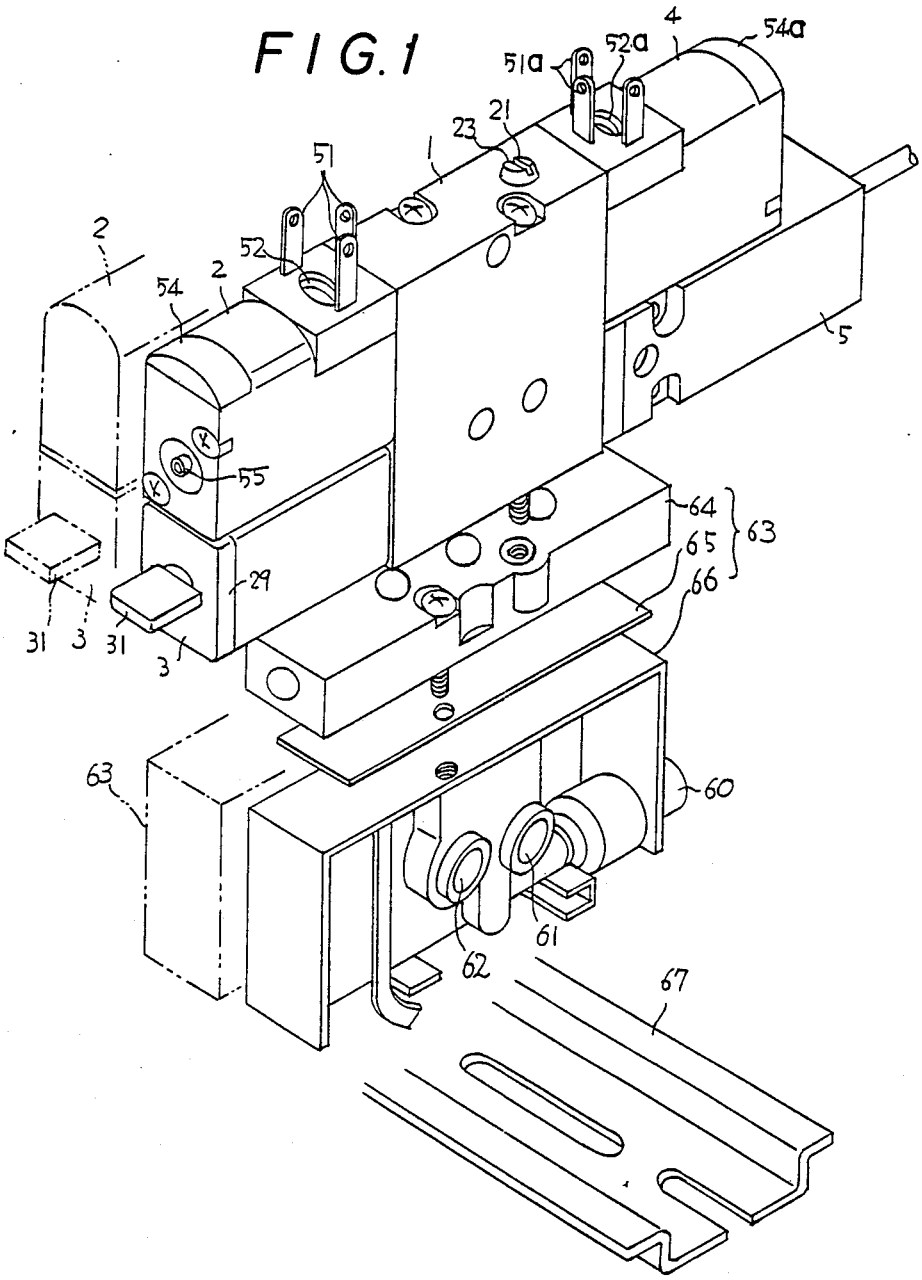
FIG. 1 is an exploded perspective view of a preferred embodiment of a vacuum generating device according to the present invention in which a rail mounting subbase is shown in a horizontally turned over state, for illustrating the back side thereof.

Referring to FIG. 1, there are arranged a vacuum generating electromagnetic valve 2, a filter 3, a vacuum breaking electromagnetic valve 4 and a vacuum switch 5 on both sides of a pump 1.

Figure 2:
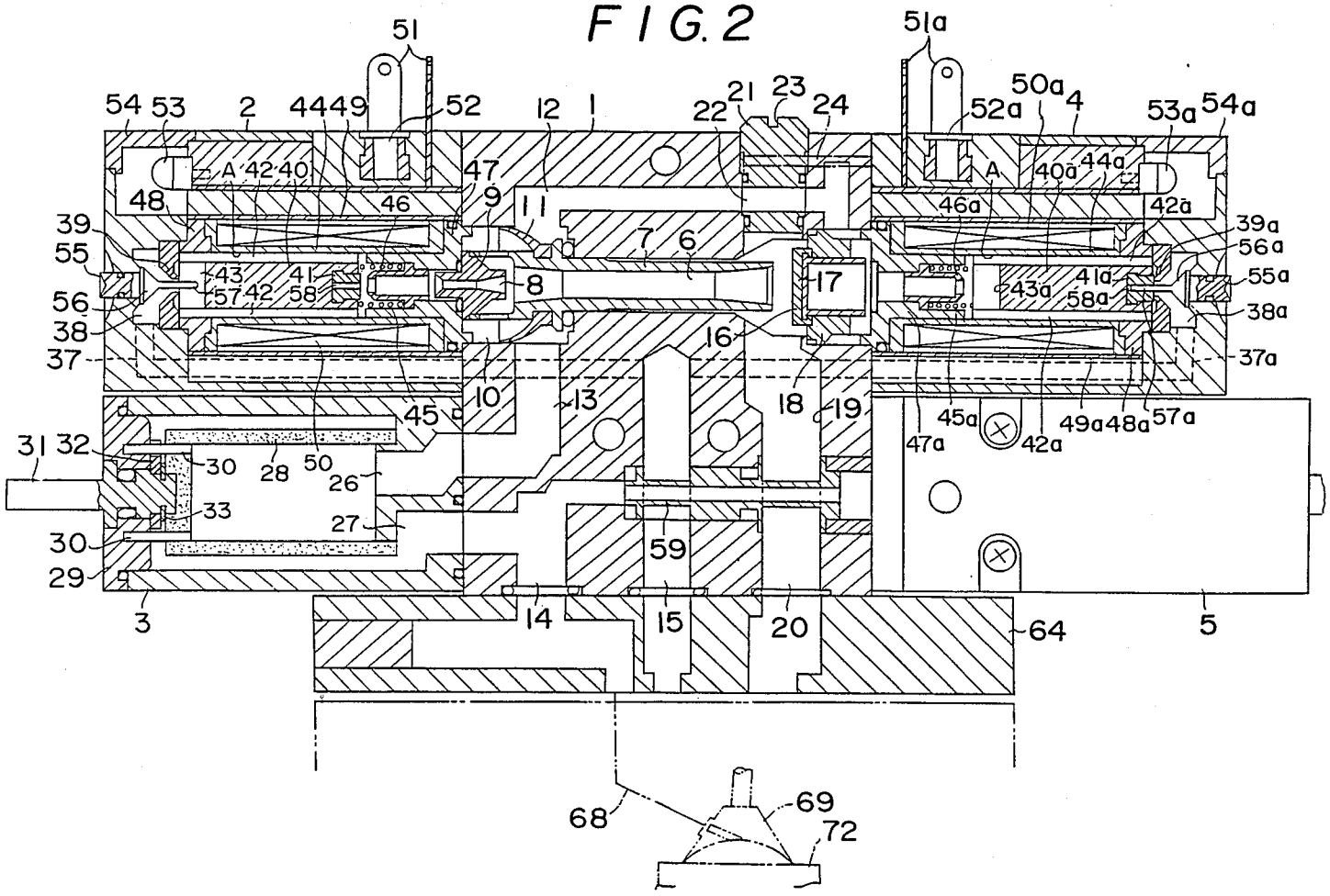
FIG. 2 is a vertical section front view of the vacuum generating device shown in FIG. 1.
Figure 2A:
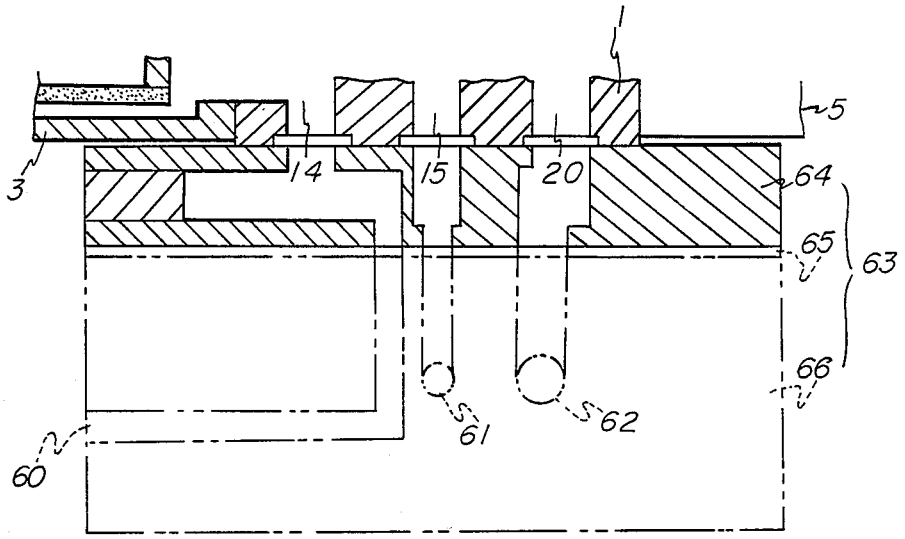
FIG. 2A is a fragmental view of FIG. 2, illustrating the details of conduits through a fitting base.
Figure 3:
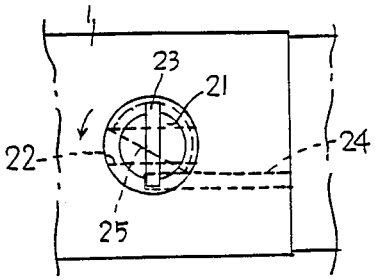
FIGS. 3 and 4 are plan views, respectively, illustrating an operation of a vacuum breaking air flow rate adjusting valve.
Figure 4:
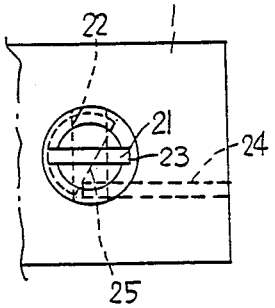

As shown in FIG. 2, the pump 1 is provided with an ejector block 7 having an ejector hole 6 and a nozzle block 9 having a nozzle hole 8 both of which blocks are located within a longitudinal aperture drilled through the pump and an air intake chamber 10 is formed between the nozzle hole 8 and the ejector hole 6. Further, on one side of the air intake chamber 10 there is provided a conical and elastic vacuum keeping valve 11 fitted on the ejector block 7 and the chamber 10 is in communication with upper and lower vent holes 12 and 13. As shown, the lower vent hole 13 communicates with anintake port 14 through the filter 3 and the upper vent hole 13 communicates with a compressed air inlet port 15 through the vacuum breaking electromagnetic valve 4. Facing an outlet end of the ejector hole 6 there is provided a sealing valve 16 having an elastic valve head 17 made of rubber or synthetic resin material and capable of shifting to a position at which it blocks the outlet end of the ejector hole 6. The cross-section of a tubular portion (right side in FIG. 2) of the sealing valve 16 is made wider than that of the opening end of the ejector hole 6 so that when compressed air is introduced into the right side of the valve 16, the valve 16 shifts toward the ejector hole 6 overcoming the pressure of the compressed air ejected from the ejector hole 6 and further, when the compressed air is supplied from the ejector hole 6 for generating vacuum, the valve 16 shifts in a direction in which it leaves away from the outlet end of the ejector hole 6. The outlet end of the ejector block 7 communicates with an exhaust port 20 via a vent hole 19. The air intake port 14, compressed air inlet port 15 and exhaust port 20 open on the same side (that is, the lower side in FIG. 2) of the pump 1. Adjacent the vent hole 12 in the upper part of the pump 1, there is provided a vacuum breaking compressed air flow rate adjusting valve 21. The adjusting valve 21 has an adjusting hole 22 capable of communicating with the vent hole 12 and an engagement groove 23 on the upper surface thereof and is prevented from slipping off the pump 1 by means of a pin 24 inserted therethrough. Further, a recess 25 is formed in the side surface of the valve 21 at a position corresponding to the pin 24 so that the valve 21 is rotated by inserting a suitable jig such as a screw driver into the engagement groove 23 until both ends of the recess 25 come into contact with the pin 24 to bring about a state in which the adjusting hole 22 is in communication with the vent hole 12 (as shown in FIGS. 2 and 3) and a state in which the adjusting hole 22 is out of communication with the hole 12 as it stands substantially normal to the hole 12. (FIG. 4).

Figure 5:
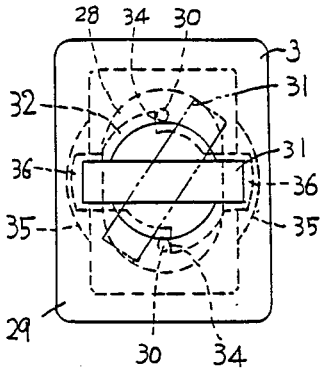
FIG. 5 is a side view of a filter used for the device shown in FIG. 1.

The filter 3 has a vent hole 26 communicating with the vent hole 13 and a vent hole 27 communicating with the air intake port 14, and a tubular filter element 28 is arranged between the holes 26 and 27. The filter element 28 is formed by sintering polypropyrene powder so as to have sufficient air permeability but it may be made of other suitable materials. Further, one end of the filter element 28 is supported by fixing pins 30 fitted into a cover 29 at the left side of the pump 1. The cover 29 is fitted with a locking knob 31 and a locking plate 32 is fixed inside the knob 31 by means of a snap-ring 33. As shown in FIG. 5, the locking plate 32 is provided with engaging claws 36 to engage with grooves 35 formed inside the filter 3, and edges 34 engaging the pins 30. Thus, when the locking knob 31 is rotated to the position shown by a chain-line in FIG. 5, the engaging claws 36 of the locking plate 32 are disengaged from the engagement grooves 35 so that the cover 29 and the filter element 28 can be removed from the filter 3 for cleaning the element 28 or replacing it with new one. On the other hand, when the locking knob 31 is returned to the position shown by a solid-line in FIG. 5, the filter element 28 can be re-mounted. Further, the filter 3 is made of a transparent synthetic resin material such as polycarbonate so as to make is possible to observe if the filter element 28 is filthy.

Figure 6:
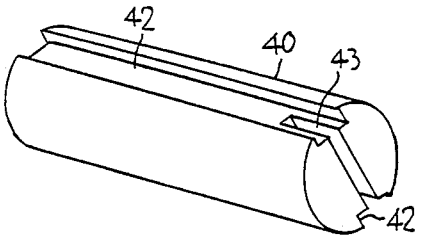
FIGS. 6 and 7 are perspective views showing end surfaces, respectively, of a plunger of the device shown in FIG. 1.
Figure 7:
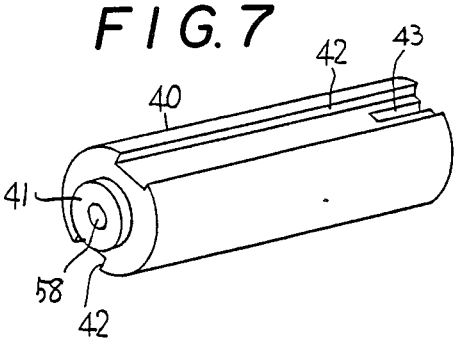
Figure 8:
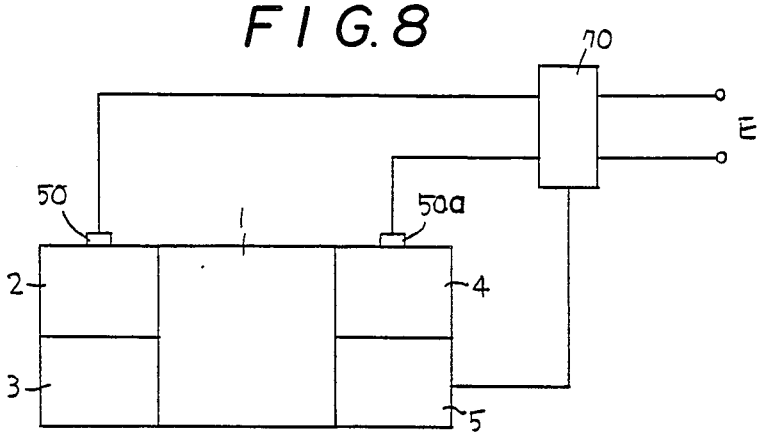
FIG. 8 is a wiring diagram for driving the device shown in FIG. 1.

The vacuum generating electromagnetic valve 2 has a vent hole 37 communicating with the compressed air inlet port 15 and opening in a fluid chamber 38. The fluid chamber 38 is provided with a valve seat 39 and a plunger 40 faces the valve seat 39. The plunger 40 has, at one end thereof, an elastic valve head 41 made of rubber or synthetic resin material, a pair of longitudinally extending elongated grooves 42 formed in the outer periphery thereof and a vertical groove 43 on the end opposite the valve head 41 so as to communicate with the grooves 42 (See FIGS. 6 and 7). The plunger 40 is slidably fitted in a valve chamber A formed in a tubular section of a bobbin 44 and is urged by a spring 45 in a direction in which it comes into contact with the valve seat 39. In the shown example, one side end of the plunger having the vertical groove 43 is in contact with the valve seat 39 and an inner valve seat 46 is held open. (Always opened). The inner valve seat 46 corresponds in position to the nozzle hole 8 of the nozzle block 9. Further, the inner valve seat 46 is fitted in a center post 47 and at one end of the bobbin 44 facing the center post 47, there is provided a plate upper 48. The outer peripheries of the center post 47 and the plate upper 48 are covered by a housing 49 and a solenoid 50 is received between the housing 49 and the bobbin 44.

The plunger 40, housing 49 and center post 47 are all made of martensite stainless steel and other magnetic materials and when the solenoid 50 is excited, the plunger 40 is attracted to the center post 43 to shift to the right as shown. Further, the electromagnetic valve 2 is provided with a power supply terminal 51, a connecting hole 52 and a lighting section comprising a LED element 53 and an acrylic resin lens 54 arranged outside the former and lighting up at the time of power supply. At the outside of the electromagnetic valve 2 there is provided a manual operation button 55 which has a large-diametered portion therein positioned in the fluid chamber 38 and an operating rod 57 extending toward the plunger 40 through the valve seat 39. As shown, the operating rod 57 faces the bottom of the vertical groove 43 of the plunger 40 and when the button 55 is pressed, the top end of the operating rod 57 comes into contact with the bottom of the vertical groove so that the plunger 40 shifts to the right against the spring 45 thereby bringing the valve head 41 into contact with the inner valve seat 46. Further, when the button 38 is released, compressed air acts on the large-diametered portion 56 of the button so that the button moves to the left to assume its original position.

The vacuum breaking electromagnetic valve 4 is of the same structure as the vacuum generating electromagnetic valve 2 so that parts of the valve 4 corresponding to those facing the valve 2 are designated by the same reference numerals each, however, added with the letter "a" throughout the drawings for the sake of convenience of illustration. Further, a plunger **40*a* is fitted in a bobbin 44*a* contrariwise to the plunger 40 and a valve head 41*a* is urged to come into contact with a valve seat 39*s* by a spring 45*a* (always closed). In a small hole 58 drilled in the valve head 41*a* there is inserted an operating rod 57 of a manual operating button 55*a* so that when the button 55*a* is pressed, the top end of the operating rod contacts the bottom of the valve head 41*a* causing the plunger 40*a* to shift to the left thereby holding the valve hole opened. Further, an inner valve seat 46*a* is opposed to the above-mentioned sealing valve 16 and the valve seat 46*a* and the vent hole 12 in the pump 1 are in communication with each other through the flow rate adjusting valve 21**.

The vacuum switch 5 is in communication with the air intake port 14 through a flow passage 59 and as is well know, opens and closes so as to control the vacuum generating electromagnetic valve depending on the degree of vacuum acting on the air intake port 14.

As shown, at the lower part of the pump 1, there is provided a fitting base 63 attached with an air intake pipe 60, an inlet pipe 61 and an exhaust pipe 62 leading to the above-mentioned air intake port 14, compressed air inlet port 15 and exhaust port 20, respectively. As shown in FIG. 1, the fitting base 63 is formed of a base plate 64, a gasket 65 and a rail mounting sub-base 66 and attached to a fitting rail 67. The fitting rail 67 may be attached with a plurality of fitting bases 63 in parallel relationships with one another and when doing so, the inlet pipes 61 and exhaust pipes 62 of the adjoining bases 63 are made to pass through the side surfaces of their respective bases so as to establish communications between the pipes 61 and between the pipes 62, respectively. Then the compressed air supply source is connected to one end of each of the inlet pipes 61 connected in sequence and suitable pipes leading to the outside of the room may be connected to one end of each of the exhaust pipes 62. The air intake pipe 60 is separately connected to one side surface of the sub-base 66 and a conduit 68 of a vacuum sucking device is connected to the air intake pipe 60 with the top end of the conduit 68 connected to a sucking disk 69 (FIG. 2). A plurality of vacuum generating devices may be assembled on the fitting rail 67 as required, and also can be dismounted therefrom for repair or replacement.

Figure 9:
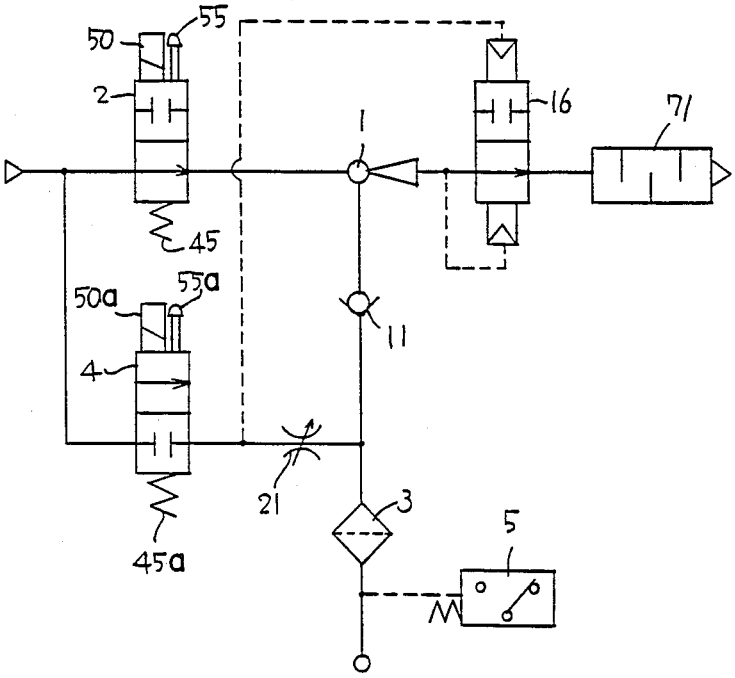
FIG. 9 is a diagram of a pneumatic circuit used for the device shown in FIG. 1.

Referring to FIG. 9 which is a pneumatic circuit diagram and FIG. 2, as the vertical groove 43 of the plunger 40 faces the valve seat 39, the electromagnetic valve 2 is open and compressed air passes through the inlet pipe 61, inlet port 15 and vent hole 37 and is injected into the ejector hole 6 from the elongated grooves 42 through the inner valve seat 46 and after sucking and discharging the air in the air intake chamber 10, is discharged outside the chamber 1. In some case, a suitable silencer 71 may be provided at the top end of the exhaust pipe 62 (FIG. 9). As the line including the vent holes 13, 26, filter element 28 and vent hole 27 and leading to the air intake port 14 is evacuated by the above-mentioned sucking and discharging operations, the pressure of the interior of the sucking disk 69 is reduced through the air intake pipe 60 and conduit 68 so that an article 72 is attracted to the sucking disk 69 and allows the article to be transferred to a desired place. When the pressure in the interior of the vacuum line reaches a predetermined negative value, the vacuum switch 5 is operated to excite the solenoid 50 of the vacuum generating electromagnetic valve 2 so that the plunger 40 shifts to the right toward the center post 47 against the spring 45, the valve head 41 comes into contact with the inner valve seat 46 to block the valve hole and the supply of the compressed air into the nozzle hole 8 is stopped while the pressure in the system is maintained at a predetermined negative value. In the event the degree of vacuum drops due to the leakage of air, the vacuum switch 5 senses it and releases the solenoid 50 from excitation whereupon the inner valve seat 46 opens to cause the compressed air to be re-injected thereby increasing the degree of vacuum in the interior of the system.

After transferring the article 72, when the solenoids 50 and 50*a* of the electromagnetic valves 2 and 4 are excited by a control device, the plunger 40 of the valve shifts to the right and the supply of compressed air into the nozzle hole 8 is suspended as aforesaid. At the same time, the plunger 50*a* of the valve 4 shifts to the left by being attracted to the center post 47*a* and the valve head 41*a* leaves away from the valve seat 39*a* to open the valve hole so that the compressed air is supplied into the air intake port 14 via the vent holes 37*a* and 12 thereby quickly releasing the negative pressure on the sucking disk 69. In this case, the sealing valve 16 moves to the left to block the outlet port of the ejector hole 6 so that the loss of the vacuum breaking compressed air is prevented. Further, the feeding time and amount of the compressed air can be adjusted by the control device and the flow rate adjusting valve 21. Upon releasing the excitation of the solenoids 50 and 50*a*, the plungers 40 and 40*a* return to the states as shown, by the springs 45 and 45*a*, respectively, so as to allow the sucking device to attract another article. The solenoids 50 and 50*a* may be substituted with the manual operating buttons 55 and 55*a*.

As described above, the present invention has various advantage that since the exhaust air inlet and exhaust pipes are attached in common to the fitting base, the number of pipes can be minimized and since the compressed air is discharged outside the room, noises and contamination of the device can be prevented. Also, as the vacuum generating electromagnetic valve 2 and filter 3, and vacuum breaking electromagnetic valve 4 and vacuum switch 5 are provided on both sides of the pump 1, these parts are assembled in a very compact form with pump 1, and can be repaired or replaced very easily, in case of occurring troubles.

It should be noted that although the present invention has been described based on a preferred embodiment thereof, various modifications and alterations can be made without departing from the spirit and scope of the invention.

What is claimed is:

1. A vacuum generating device comprising an ejector pump 1 having at least three side surfaces, a vacuum generating electromagnetic valve 2 and a filter 3 each disposed on one of said side surfaces of said pump 1, and a vacuum breaking electromagnetic valve 4 and a vacuum switch 5 each disposed on another of said side surfaces of said pump 1, said ejector pump 1 having a nozzle hole 8, an ejector hole 6 and an air intake chamber 10 formed therebetween, wherein air in said air intake chamber 10 is discharged therefrom by injecting compressed air from said nozzle 8 into said ejector hole 6 so that a vacuum is generated in a system connected to said air intake chamber 10, said pump 1 being provided the third of said side surfaces thereof with an air intake port 14 communicating with said air intake chamber 10 through said filter 3 and a vacuum keeping valve 11 provided in said pump 1, and said vacuum switch 5 being in communication with said air intake port 14, a compressed air inlet port 15 communicating with said nozzle hole through said vacuum generating electromagnetic valve 2, as well as communicating with said air intake port 14 through said vacuum breaking electromagnetic valve 4, and an exhaust port 20 leading to said ejector hole 6, and attached on said one of the remaining side surfaces of said pump 1 with a fitting base 63 which is provided with an air intake pipe 60, an air inlet pipe 61 and an exhaust pipe 62 capable of communicating with said air intake port 14, said air inlet port 15 and said exhaust port 20 in said pump 1, respectively said compressed air inlet port 15 and said exhaust port 20 passing sidewardly through said fitting base 63, whereby when a plurality of said vacuum generating devices are assembled on a fitting rail 67, the fitting bases 63 of said vacuum generating devices are arranged parallel and close to one another in a compact form with said air inlet pipes 61 and said exhaust pipes 62 being held in communication with one another, respectively.

* * * * *